US006666597B1

(12) United States Patent
Neri et al.

(10) Patent No.: US 6,666,597 B1
(45) Date of Patent: Dec. 23, 2003

(54) GEARED DRIVE HUB ASSEMBLY FOR A PRINTER CARTRIDGE

(75) Inventors: Joel D Neri, Youngstown, NY (US); Oliver Duerr, Long Valley, NJ (US); Jens Duerr, Pittstown, NJ (US)

(73) Assignee: International Imaging Materials Inc., Amherst, NY (US)

( * ) Notice: Subject to any disclaimer, the term of this patent is extended or adjusted under 35 U.S.C. 154(b) by 0 days.

(21) Appl. No.: 09/999,478

(22) Filed: Oct. 31, 2001

(51) Int. Cl.[7] ..... B41J 33/22; B41J 33/16

(52) U.S. Cl. ..... 400/236.2; 400/223

(58) Field of Search ..... 400/223, 207, 400/208, 208.1, 221, 221.1, 221.2, 230, 236, 236.1, 236.2, 242, 307, 307.1, 307.2

(56) References Cited

U.S. PATENT DOCUMENTS

| | | | | | |
|---|---|---|---|---|---|
| 3,788,221 | A | * | 1/1974 | Borneman | 101/116 |
| 3,894,733 | A | * | 7/1975 | Borneman | 271/283 |
| 4,568,210 | A | * | 2/1986 | Privitera | 400/235.1 |
| 4,673,304 | A | * | 6/1987 | Liu et al. | 400/208 |
| 5,439,303 | A | * | 8/1995 | Alday | 400/242 |
| 5,442,449 | A | * | 8/1995 | Stemmle et al. | 358/296 |
| 5,570,633 | A | * | 11/1996 | Schultz et al. | 101/182 |
| 6,102,509 | A | * | 8/2000 | Olson | 347/8 |
| 6,161,972 | A | | 12/2000 | Kameyama et al. | |

* cited by examiner

*Primary Examiner*—Daniel J. Colilla
(74) *Attorney, Agent, or Firm*—Howard J. Greenwald

(57) ABSTRACT

A geared drive hub assembly for a printer cartridge containing a geared drive hub removably engaged with a spool. The geared drive hub contains a gear and a base connected to the gear; the base is integrally connected to a first stepped spline, a second stepped spline, and a third stepped spline. The spool contains a device for engaging each of the stepped splines.

10 Claims, 6 Drawing Sheets

GEARED DRIVE HUB ASSEMBLY FOR A PRINTER CARTRIDGE

FIELD OF THE INVENTION

A geared drive hub assembly for a printer cartridge containing a geared hub drive removably engaged with a spool.

BACKGROUND OF THE INVENTION

U.S. Pat. No. 6,161,972 of Kameyama Yoshikatsu discloses an ink ribbon cartridge having a particular spool and spindle arrangement. The spindles used in the device of this patent each have one end which includes a disk shaped section, and a spindle portion 64 which includes projections 65 and 66 disposed 150 degrees apart from each other (see FIGS. 11 and 12).

The spindles disclosed in U.S. Pat. No. 6,161,972, although they have some limited utility when used with the spools disclosed in such patent, cannot readily be used with other spools. Furthermore, they tend to fail when more than a minimal amount of shear force is applied to the projections 65 and 66 and, in general, have inferior mechanical properties.

It is an object of this invention to provide a novel spindle which can be used with many different spools and which has improved mechanical properties.

SUMMARY OF THE INVENTION

In accordance with this invention, there is provided a geared drive hub assembly removably engaged with a spool. The drive hub contains a gear integrally connected to a spindle assembly. The spindle assembly contains three stepped splines integrally connected to each other and to a base; and the spool is comprised of means for removably engaging each of the three stepped splines.

BRIEF DESCRIPTION OF THE DRAWINGS

The invention will be described by reference to the following drawings, in which like numerals refer to like elements, and in which.

DESCRIPTION OF THE PREFERRED EMBODIMENTS

Figure 1:
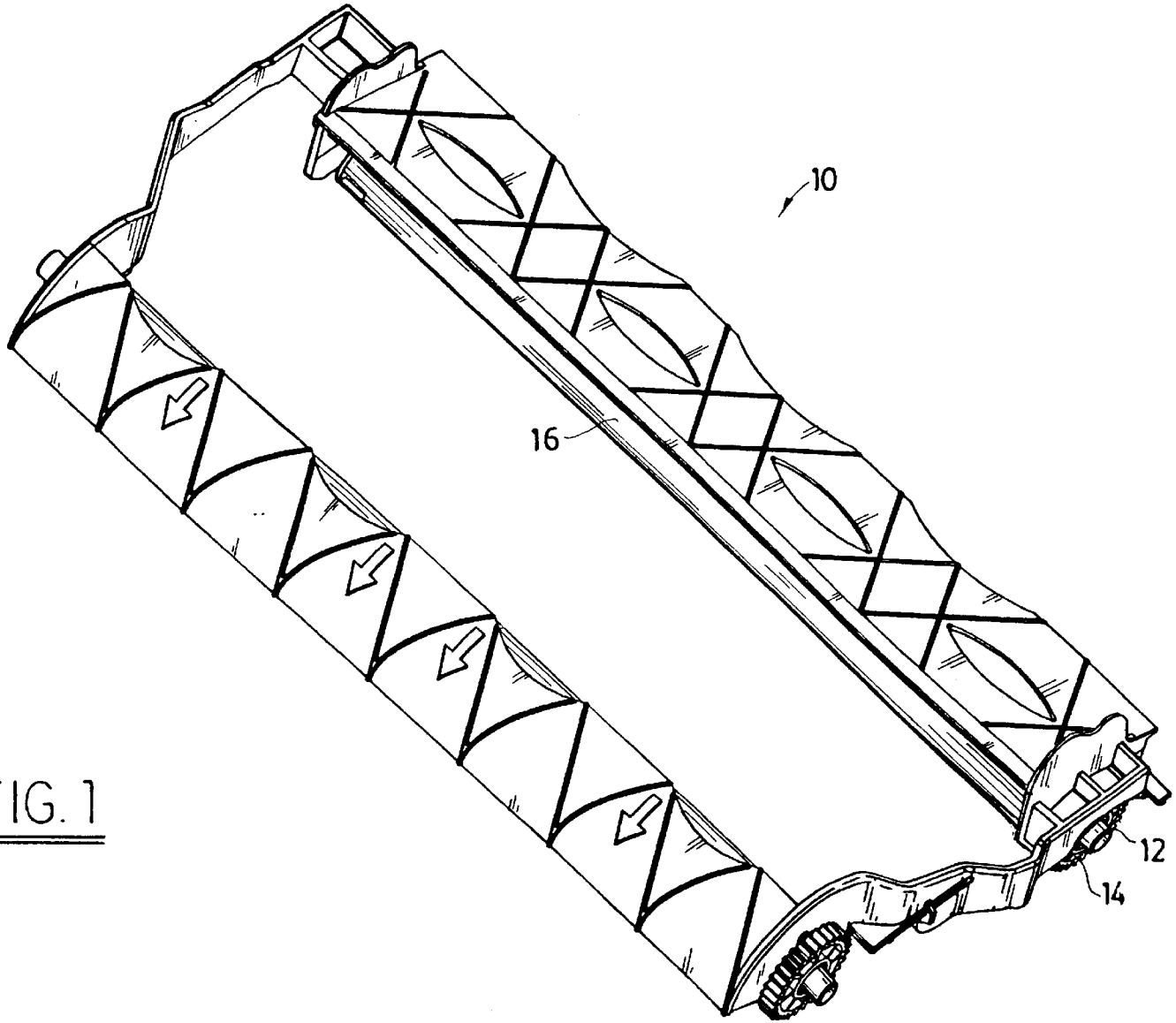
FIG. 1 is a perspective view of a printer cartridge comprised of the geared drive hub of this invention.

FIG. 1 is a perspective view of a printer cartridge 10 comprising gear drive hub 12 operatively connected to a spool 16 The gear drive hub 12 is comprised of a gear 14 which, when the cartridge 10 is disposed within a printer, is engaged by another gear (not shown) and caused to rotate.

In recent years, printers have become faster and faster, in response to consumer demand. The faster the printer, the faster gear 14 must turn, and the more torque that is applied to such gear 14, its component parts, and the spool 16 with which it is operatively engaged. The geared drive hub 12 is well suited to cope with the increased stresses and strains imposed by the use of modern printers.

In the preferred embodiment depicted in FIG. 1, the spool 16 is preferably constructed from a plastic material. The use of such a plastic spool eliminates the possibility of contaminating the printer ribbon (not shown) with particles of cardboard material from the cardboard spool commonly used in prior art devices.

In one embodiment, spool 16 consists essentially of plastic material. One may use plastics such as, e.g., acrylonititrile/butadiene/styrene (ABS), polystyrene, "DELRIN" (an acetal resin manufactured by the Du Pont de Nemours E.I. & Company of Wilmington, Del.), and the like.

Figure 2A:
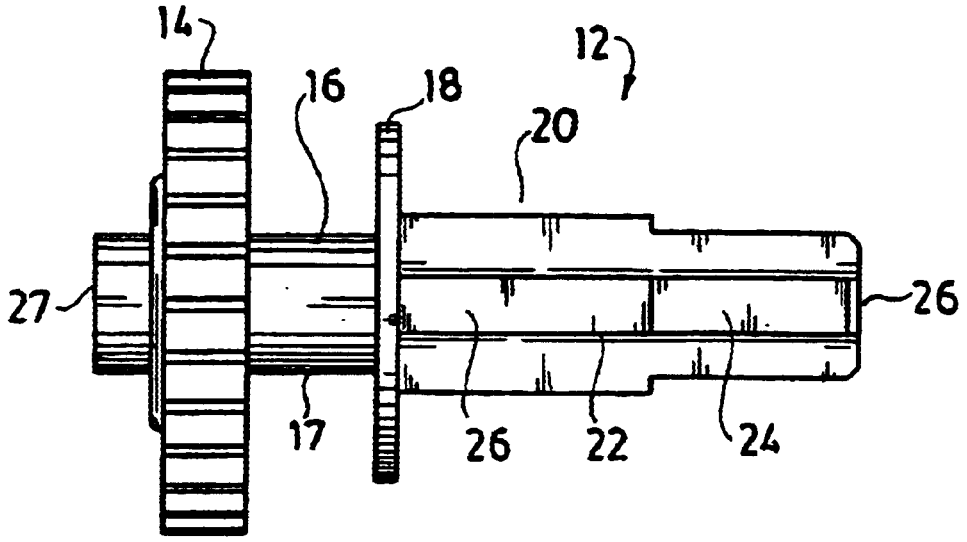
FIG. 2A is a side view of the geared hub drive of FIG. 1 engaged a spool.

FIG. 2A is a side view of one preferred geared drive hub 12 of the invention. Referring to FIG. 2A, and in the preferred embodiment depicted therein, it will be seen that gear drive hub 12 is comprised of gear 14 which is connected by means of shaft 17 to the base 18 of the gear drive hub 12.

Connected to base 18, and preferable integrally connected to base 18, is splined section 20. Splined section 20 is preferable comprised of a multiplicity of stepped splines.

As is known to those skilled in the art, a spline is a device which permits the transmission of rotation or translatory motion along the axis of a shaft. Reference may be had, e.g., to U.S. Pat. Nos. 6,152,913, 5,620,427, 4,688,478, 4,237,750, and the like. The entire disclosure of each of these United States patents is hereby incorporated by reference into this specification.

The splined section 20 preferable contains three stepped splines. Without wishing to be abound to any particular theory, applicants believe that the use of such three stepped splines affords their claimed structure umproved stability, better concentricity around the rotational axis of the gear splined hub, better distribution of torque, and better accuracy. With the high-speed printers commonly in use today, these features are especially important.

Referring again to FIG. 2A, one of the stepped splines, stepped spline 22, is shown on the gear splined hub 12. As will be apparent, stepped spline 22 is comprised of a lower section 24 communicating with an upper section 26.

Figure 2B:
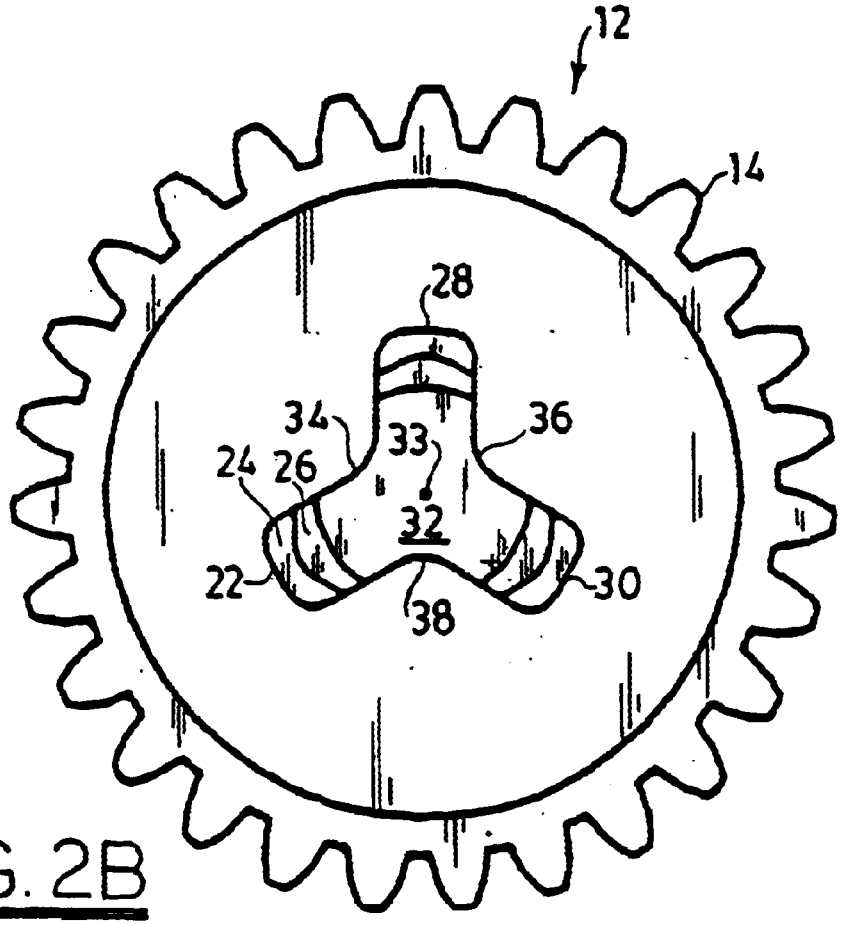
FIG. 2B is a first end view of the assembly of FIG. 2A.

FIG. 2B is an end view of geared drive hub 12, taken facing upper section 26 (see FIG. 2A) and illustrating splined assembly 20 and the stepped splines 22, 28, and 30 which comprise such splined assembly 20. This Figure is not to scale, having been enlarged for the sake of simplicity of representation.

As will be apparent, and in the preferred embodiment depicted in FIGS. 2A and 2B, stepped splines 22, 28, and 30 are integrally connected to a central portion 32 to provide one integral assembly.

In the preferred embodiment depicted in FIG. 2B, arcuate sections 34, 36, and 38 are disposed, respectively, between stepped splines 22 and 28, 28 and 30, and 30 and 22, respectively. These arcuate sections are commonly referred to as fillets.

Without wishing to be bound to any particular theory, applicants believe that the use of fillets 34, 36, and 38 provide a stronger splined assembly 20.

Figure 2C:
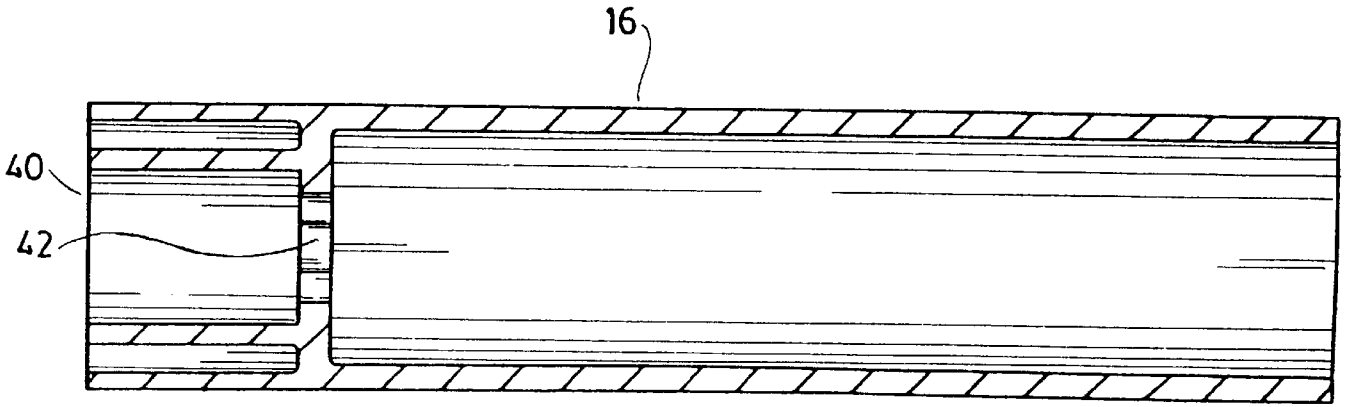
FIG. 2C is a partial sectional view of the assembly of FIG. 2A.

FIG. 2C is a sectional view of a spool 16 which may be used with the geared drive hub 12 depicted in FIGS. 2A and 2B. The upper section 26 of gear drive hub 12 (see FIG. 2A) is inserted into end 40 of spool 16 and, in particular, is disposed within receptacle 42 in which the stepped splines 22, 28, and 30 (see FIG. 2C) are engaged within such receptacle 42.

Figure 2D:
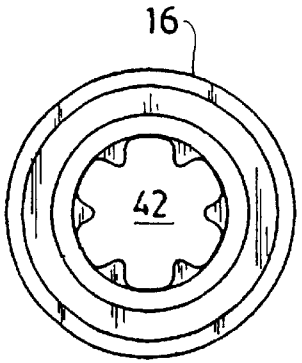
FIG. 2D is a partial sectional view of the assembly of FIG. 2A.

FIG. 2D is an end view of the spool 16, indicating the cross-sectional shape of one embodiment of the receptacle 42 with which the splines 22, 28, and 30 engage.

Figure 2E:
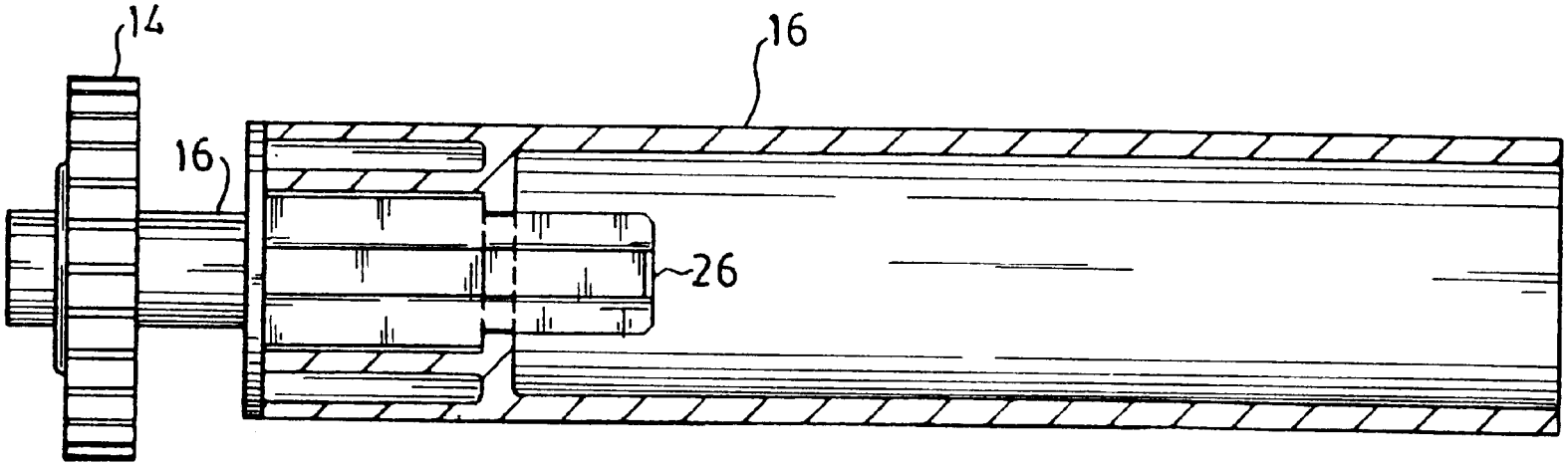
FIG. 2E is a sectional view of the assembly of FIG. 2A.
Figure 3A:
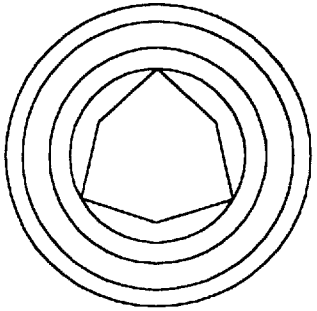
FIGS. 3A to 3F each present a schematic representation of how the geared drive hub depicted in FIG. 2A may be used with different spools to produce different assemblies.
Figure 3B:
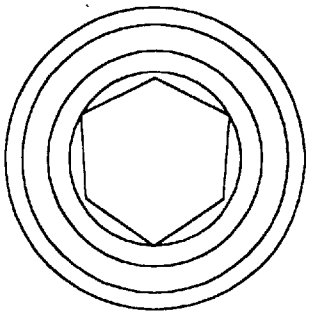
Figure 3C:
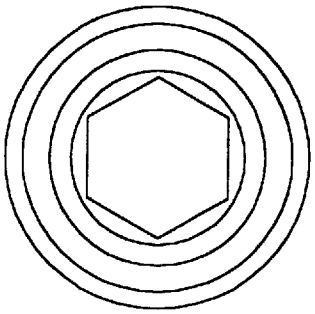
Figure 3D:
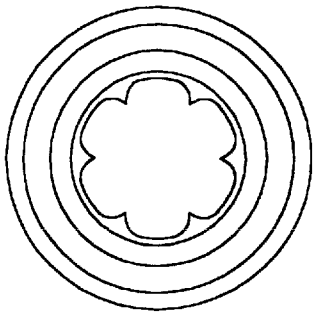
Figure 3E:
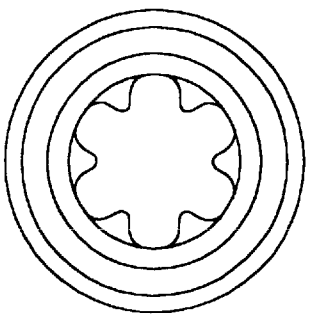
Figure 3F:
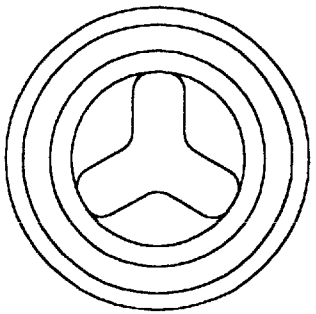

FIG. 2E is a sectional view of the gear drive hub 12 disposed within the spool 16.

The stepped spline structure depicted in FIG. 2B preferably has stepped splines 22, 28, and 30 disposed equidistantly about centerpoint 33, located about 120 degrees from each other. This preferred stepped spline structure not only is capable of engaging the cross-sectional shape of receptacle 42, but it is also capable of engaging with the cross sectional shapes depicted in FIG. 3 and, in particular, FIGS. 3A, 3B, 3C, 3D, 3E, and 3F. Other cross-sectional shapes with which such splines may engage will be apparent to those skilled in the art.

Figure 4:
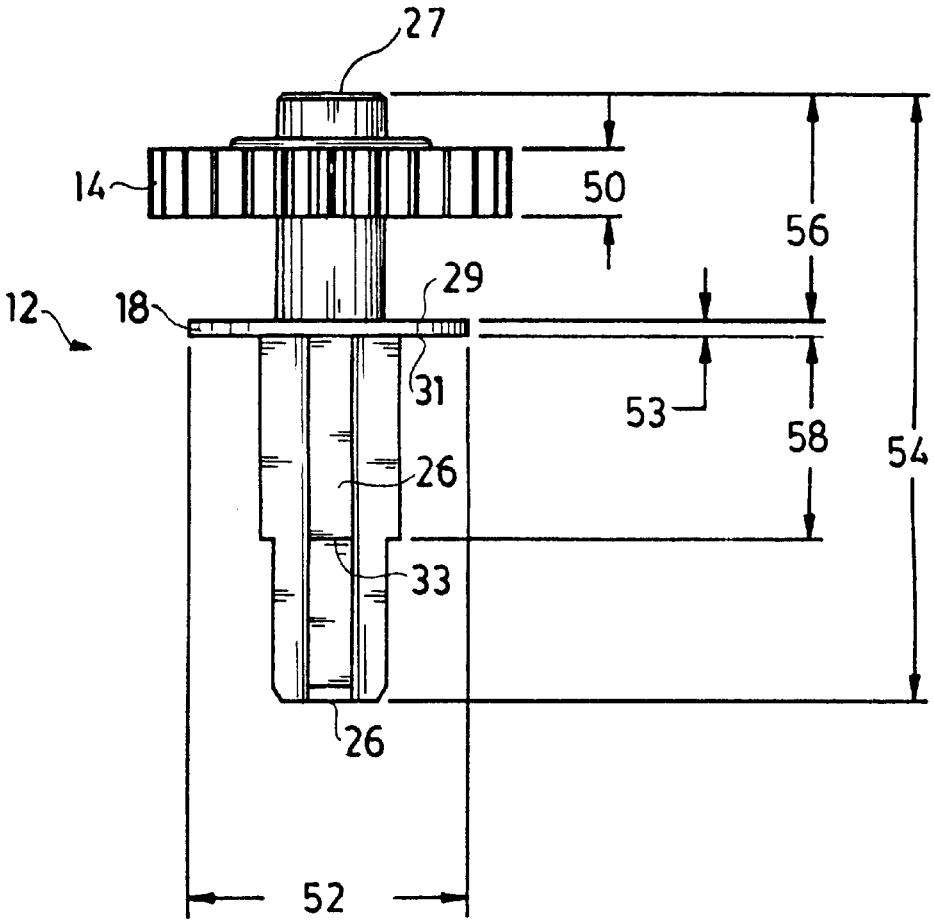
FIG. 4 is a front view of the geared drive hub depicted in FIG. 2.

FIG. 4 is a sectional view of one preferred embodiment of geared drive hub 12. In the preferred embodiment depicted in FIG. 4, it will be seen that gear 14 has a thickness 50 of 0.16 inches, base 18 has a diameter 52 of 0.7 inches and a thickness 53 of 0.04 inches, the overall length 54 of geared drive hub 12 is 1.485 inches, the distance 56 between end 27 of the geared hub drive 12 and the top surface 29 of base 18 is 0.545 inches, and the distance 58 between the bottom surface 31 of the base 18 and the end 33 of upper spline section 36 is 0.5 inches.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A geared drive hub assembly for a printer cartridge comprised of a geared drive hub removably engaged with a spool, wherein:

(a) said geared drive hub is comprised of a gear and a base connected to said gear, wherein said base is integrally connected to a first stepped spline, a second stepped spline, and a third stepped spline, and (b) said spool is comprised of means for engaging said first stepped spline, said second stepped spline, and said third stepped spline.

2. The geared drive hub assembly as recited in claim 1, wherein said spool consists essentially of plastic material.

3. The geared drive hub assembly as recited in claim 1, wherein said geared drive hub is comprised of a shaft.

4. The geared drive hub assembly as recited in claim 1, wherein said shaft is disposed between and connected to each of said gear and said base.

5. The geared drive hub assembly as recited in claim 1, wherein a first fillet is disposed between said first stepped spline and said second stepped spline, a second fillet is disposed between said second stepped spline and said third stepped spline, and a third fillet is disposed between said third stepped spline and said first stepped spline.

6. The geared drive hub assembly as recited in claim 1, wherein said base has a substantially cylindrical cross-sectional shape.

7. The geared drive hub assembly as recited in claim 6, wherein said base is comprised of a centerpoint.

8. The geared drive hub assembly as recited in claim 7, wherein said first stepped spline, said second stepped spline, and said third stepped spline are disposed substantially equidistantly around said centerpoint.

9. The geared drive hub assembly as recited in claim 1, wherein each of said first stepped spline, said second stepped spline, and said third stepped spline is comprised of a lower section communicating with an upper section.

10. The geared drive hub assembly as recited in claim 9, wherein said spool has a substantially cylindrical shape.

* * * * *